United States Patent [19]

DeVries

[11] Patent Number: 4,659,085

[45] Date of Patent: Apr. 21, 1987

[54] BOARD GAME MATCHING NUMBERED SIDES OF RECTANGULAR PIECES

[76] Inventor: Joseph DeVries, 6855 Thorndale Ave., Chicago, Ill. 60631

[21] Appl. No.: 781,033

[22] Filed: Sep. 27, 1985

[51] Int. Cl.[4] ..... A63F 3/00

[52] U.S. Cl. ..... 273/236; 273/292

[58] Field of Search ..... 273/137, 236, 267, 268, 273/271–273, 281–284, 237, 292; 434/189, 193, 118

[56] References Cited

U.S. PATENT DOCUMENTS 487,797 12/1892 Thurston .
490,689 1/1893 Thurston .
1,450,874 4/1921 Stromee ..... 273/292
1,666,448 4/1928 Hardenstein ..... 273/292
4,299,391 11/1981 Silver ..... 273/272

*Primary Examiner*—Richard C. Pinkham
*Assistant Examiner*—MaryAnn Stoll Lastova
*Attorney, Agent, or Firm*—Eugene I. Snyder

[57] ABSTRACT

There is described a board game having $(n+3)^2$ playing spaces and an equal number of playing pieces, of which $(n+1)(3n/2+1)$ are numbered on each side and the remainder are blank. The numbered tiles are divided into three groups: one group has members whose numbers on each side are identical; a second group has a number on one side different from the numbers on the other sides; the third group has two pairs of numbers on each piece with the members of each pair on opposite sides. Several variations in play are described.

1 Claim, 5 Drawing Figures

FIG. 1
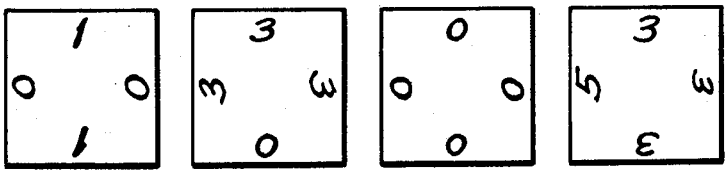
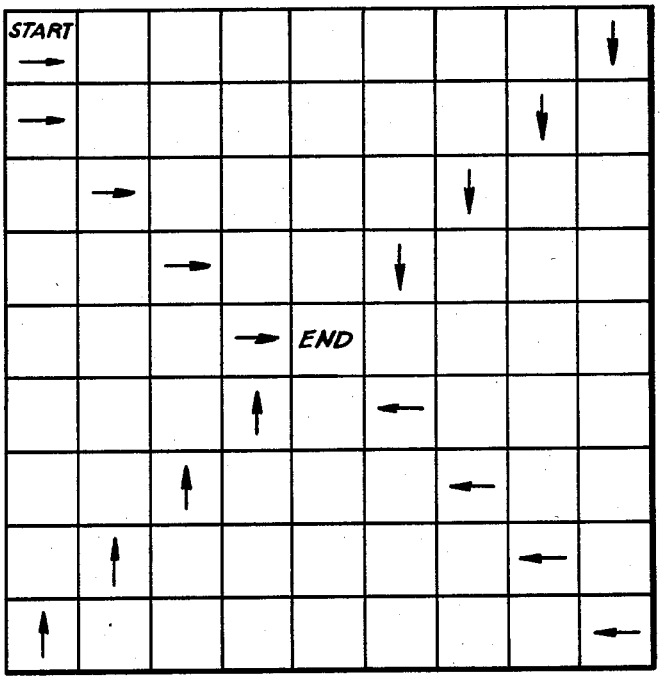
FIG. 2
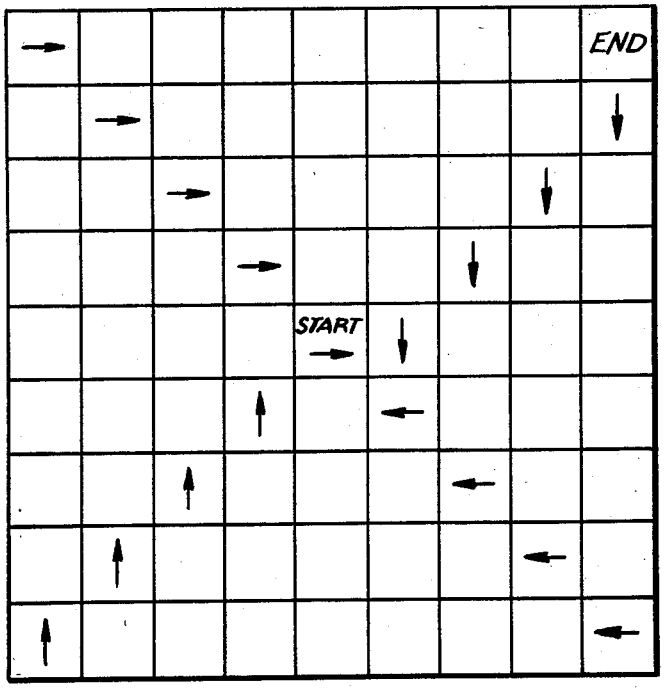
FIG. 3

FIG. 4
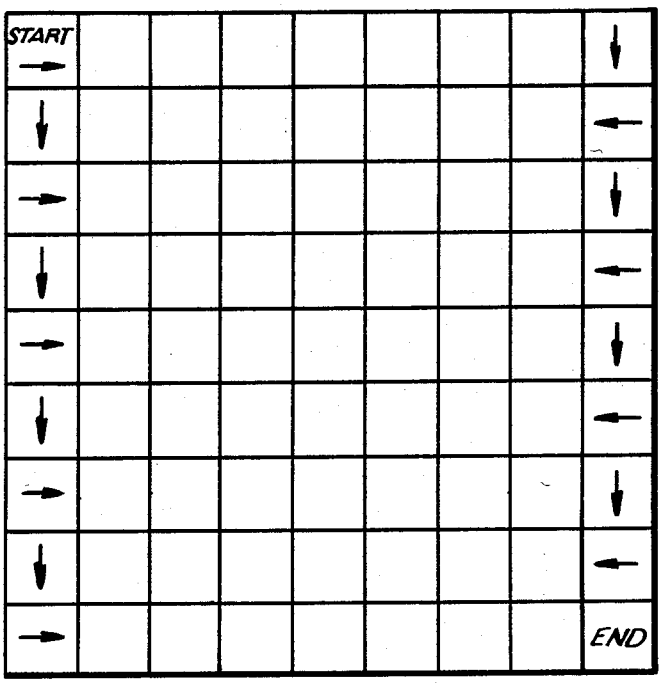
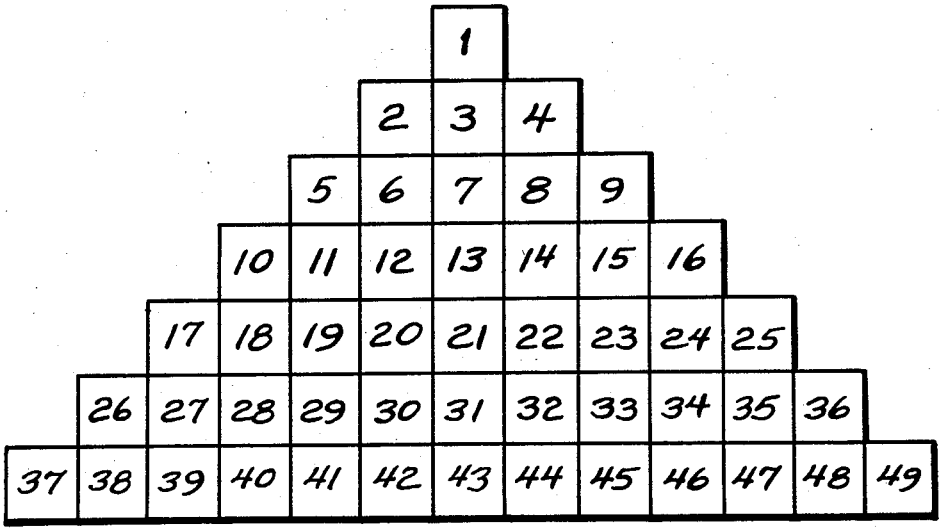
FIG. 5

BOARD GAME MATCHING NUMBERED SIDES OF RECTANGULAR PIECES

Board games using a rectangular playing area with rectangular spaces on which are placed rectangular pieces whose different sides are distinctly identified form a generic class of games with a very large number of members. However, because there are a large number of means of identifying sides and of choosing and identifying sequences, many distinct and discrete variations are possible. This invention is another member of the aforementioned class which is quite different from any other member, affording yet another board game giving enjoyment, challenge and relaxation to the young and old alike.

The closest prior art may include U.S. Pat. No. 1,450,874 whose game pieces have four numerals, one on each side, with all four numerals either alike or occurring in two pairs of different numbers. In the latter case, the members of each pair are on adjacent sides. The game described there fails to use pieces where three numerals are alike, nor does it use pieces where two pairs of numerals are so placed that the members of each pair are on opposite sides, both of which features are incorporated in the present invention. Still another game which may be relevant to the invention described herein is that of U.S. Pat. No. 1,666,448, where the rectangular pieces either have all the numbers the same, or in combinations so that one pair on opposite sides sums to nine where the other pair consists of adjacent unused odd or even numbers. The game described therein has many distinctions from the present invention, since the game within has at most two pair of numerals, that is, there are no more than two different numbers on each piece, and the members of each pair are chosen in quite different ways from that of the cited patent. Thurston also describes some puzzles in U.S. Pat. Nos. 487,797 and 490,689 which may be considered relevant to the present invention. However, it is believed that the game described within is quite different and distinct from any in the prior art.

SUMMARY OF THE INVENTION

My invention is a board game comprising a rectangular board, whose number of playing spaces is the square of an integer, and an equal number of playing pieces, some of which are blank and the remainder having numbers on each side arranged in a particular mathematical sequence. In one specific embodiment the playing board has from 49 to 100 squares. In a more specific embodiment each side of each playing piece has a number from zero to six with all sides being the same, or one side being different from the other three, or with sides having numbers in pairs on opposite sides.

DESCRIPTION OF THE FIGURES

FIG. 1 shows several representative examples of the numbered tiles of this invention.

FIGS. 2-5 show different variations of playing or moving the tiles on the board.

DESCRIPTION OF THE INVENTION

My invention is a board game. More particularly, the board is one with rectangular playing spaces with the spaces themselves arranged in a rectangular array. In a preferred embodiment the array is a square, that is, the number of playing spaces is the same on each side of the rectangular array. Even more particularly, the board is itself a square composed of square playing spaces. Although any number of squares may be used, it has been found most suitable to have a playing board with $(n+3)^2$ squares where n is an integer from four to seven. Thus, in the most preferred embodiment the playing board contains from 49 to 100 squares, although it is to be clearly understood that boards with smaller, and more particularly larger, number of playing spaces may be used where desired.

The playing pieces generally are rectangular tiles, and more usually are square tiles. The number of tiles used in the game is the same as the number of playing spaces on the board. The number of tiles having a numeral on each of its four sides is $(n+1)(3n/2+1)$, the remainder of the tiles being blank. So, for example, where there are 100 playing spaces there will be 92 tiles which have numbers and 8 which are blank; for 81 playing spaces there will be 70 numbered tiles and 11 blank ones; for 64 playing spaces there will be 51 numbered and 13 blank tiles; and so forth.

The arrangement of the numbers on the playing tiles distinguishes this game from the prior art. The numbered tiles form three groups. In one group all the tiles have the same number on each side. Another group of tiles has a number on one side which is different from the number which is found on the other three sides. The third group of tiles has two pairs of numbers on each piece, with the members of each pair on opposite sides of the tile. The number of tiles in the first group is $(n+1)$; the number of tiles in the second group is $n(n+1)$; the number of tiles in the last group is $n(n+1)/2$.

The tiles which are used in this game can be more easily understood by means of the following detailed example where n is 6. In this case, the numbers which may appear on each tile are 0, 1, 2, 3, 4, 5, or 6. There will be seven tiles all of whose numerals are the same, that is, 0000, 1111, 2222, . . . , 6666, which form the first group of tiles.

The second group of tiles has 42 members. The arrangement of numbers are 0001, 0002, 0003, . . . , 0006, 0111, 0222, 0333, . . . , 0666, 1112, 1113, . . . , 1116, 1222, 1333, . . . , 1666, 2223, . . . , 2226, 2333, 2444, . . . , 2666, 3334, . . . , 3336, 3444, . . . , 3666, 4445, 4446, 4555, 4666, 5556 and 5666.

The last group of tiles has 21 members and has pairs of numerals on opposite sides as given by the sequences 0101, 0202, . . . , 0606, 1212, 1313, . . . , 1616, 2323, . . . , 2626, 3434, . . . , 3636, 4545, 4646 and 5656.

It will be clear from the foregoing that symbols, colors and so forth, may be substituted for distinct numbers without changing the substance of my game, and all such variations where there is mere substitution for the numbers are to be understood as being within the scope of my invention.

There are many variations in playing games based upon my invention. Several variations will be exemplified, but it is to be completely understood that these are merely illustrative and not in any way exhaustive of the possible game variations which may be enjoyed.

The playing tiles are placed face down and thoroughly mixed. Each player then selects a number of tiles. In the case where there are 100 tiles total, it has been found convenient for each player to select ten tiles where there are from two to four players, eight tiles where there are five or six players, and six tiles where there are seven or eight players. The tiles are then examined by the player choosing them, and the player who has chosen the tile with all four sixes beginning play. If no one has four sixes, the one with the highest grouping of four numbers begins the game. If no player has four of the same number, the player with the highest total of all numbers on one tile begins. The starting player has the privilege of choosing which game variation will be followed. Play always continues with each player in turn playing one tile by adding it to the pattern of the game variation in such a way as to match the number or numbers on the adjacent tile(s). For example, in one variation play may start in one of the corners of the playing board, for example, the upper left-hand corner. Play then continues along each side until all the playing pieces on the perimeter are occupied, at which point play continues along the same pattern on the second row, then the third row, and so forth, until all the squares are occupied.

If a player cannot make a play with the tiles before him, he must draw from the pool one tile and the play passes to the next player. Blank tiles are wild tiles and may be played only after there are no tiles remaining in the pool. Play continues until one player has played all of the tiles before him, and that player is declared the winner of the round. If an impasse is reached with no player being able to add to the pattern, the player with the least number of tiles is declared the winner. If two or more such players are tied, then the player with the lowest total number of the numbers on the tile is declared the winner.

As many variations as there are in the play of the game, there are at least an equal number of variations in scoring the game. For example, the player starting the round with a tile of four numbers which are the same may receive a bonus of, for example, 50 points. However, if play is begun with a tile other than one of four numbers, that player may receive a bonus of only, say, 25 points. Any player playing a tile with four numbers the same during the game receives 25 points for that play. If a player must pass on his turn, he receives a penalty of 10 points, so long as his score does not go negative. The winner of each round receives, say, 50 points, plus the total of the numbers on all unplayed tiles of his opponents. Play continues until a predetermined score is reached.

As previously stated, the variations in game play are limited only by one's imagination. Several such variations are shown in the figures. In FIG. 2, which already has been described, play starts on, for example, the upper left-hand corner, continues around the perimeter of the playing board until all such playing spaces are occupied, then continues along the second row in a similar vein according to the arrows indicated in that figure. The variation shown in FIG. 3, where play is begun in the center of the playing board and expanding squares are occupied around this centrally-occupied square, is essentially the reverse of that described in FIG. 2. In the variation as shown in FIG. 4, play starts at one corner of the board, continues along that row, then reverses direction as the next row is occupied by tiles, and so forth. FIG. 5 shows a particularly interesting variation of this game which is pyramidal in shape. In particular, we start at the top of the pyramid with play continuing in the sequence as indicated by the numbers of each square. The pyramidal game is itself susceptible of many variations which will occur to the reader, depending upon the particular sequence of playing the tiles which is chosen.

As will be clear at this point, the board game which is my invention is susceptible of a multitude of variations which will occur to the interested player. It is to be clearly understood that all such variations are within the scope of my invention and are intended to be encompased by it.

What is claimed is:

1. A board game with 81 playing spaces and an equal number of tiles, of which 11 tiles are blank and 70 have a number which is 0 or an integer from 1 to 6 on each of their sides composed of: a set of seven tiles having the numbers {0,0,0,0}, {0,0,0,1}, {0,0,0,2}, {0,0,0,3}, {0,0,0,4}, {0,0,0,5}, {0,0,0,6}; three sets of six tiles in each set, having numbers {0,1,0,1} to {0,6,0,6}, {0,1,1,1} to {0,6,6,6} and {1,1,1,1} to {1,1,1,6}, respectively; three sets of five tiles in each set, having the numbers {1,2,1,2} to {1,6,1,6}, {1,2,2,2} to {1,6,6,6} and {2,2,2,2} to {2,2,2,6}, respectively; three sets of four tiles in each set, having the numbers {2,3,2,3} to {2,6,2,6}, {2,3,3,3} to {2,6,6,6}, and {3,3,3,3} to {3,3,3,6}, respectively; three sets of three tiles in each set, having the numbers {3,4,3,4} to {3,6,3,6}, {3,4,4,4} to {3,6,6,6}, and {4,4,4,4} to {4,4,4,6}, respectively; three sets of two tiles in each set, of {4,5,4,5} and {4,6,4,6} and {4,5,5,5}, {4,6,6,6}, and {5,5,5,5} and {5,5,5,6}; and three unit sets of {5,6,5,6}, {5,6,6,6}, and {6,6,6,6}.

* * * * *